United States Patent [19]

Chiba et al.

[11] 4,245,675

[45] Jan. 20, 1981

[54] WEAVING LOOM WITH IMPROVED GUIDE MEANS FOR FABRIC

[75] Inventors: Yoshiharu Chiba; Masahiro Masuda, both of Tokyo, Japan

[73] Assignee: Nissan Motor Company, Limited, Japan

[21] Appl. No.: 943,929

[22] Filed: Sep. 20, 1978

[30] Foreign Application Priority Data

Oct. 20, 1977 [JP] Japan ..... 52-125083

[51] Int. Cl.[3] ..... D03D 49/00

[52] U.S. Cl. ..... 139/304; 139/305; 139/291 R; 26/101; 242/76

[58] Field of Search ..... 139/291 R, 292, 304, 139/305; 26/87, 101; 66/147, 149 R; 242/76

[56] References Cited

U.S. PATENT DOCUMENTS

| | | | |
|---|---|---|---|
| 545,607 | 9/1895 | Palmer | 139/305 |
| 1,503,871 | 4/1924 | Bartholomew | 139/305 |
| 2,486,121 | 10/1949 | Corn | 242/76 |
| 2,592,090 | 4/1952 | Weaver | 26/87 |
| 3,106,365 | 10/1963 | Karr | 26/87 |

*Primary Examiner*—Henry Jaudon

*Attorney, Agent, or Firm*—Robert E. Burns; Emmanuel J. Lobato; Bruce L. Adams

[57] ABSTRACT

In a weaving loom having a frame and a take-up roller spanned between first and second spaced sections of the frame to wind thereon a fabric, a resilient rod is spanned between the first and second spaced sections to cross the fabric at a position upstream of the take-up roller while being in slidable contact with the fabric, and camber producing means is arranged to flex the resilient rod to produce a camber which protrudes towards the fabric pressing same and is changeable in shape in response to the degree of a biasing force applied to the resilient rod. Thus, the desired form of the camber appropriate for neat winding of the fabric on the take-up roller is easily provided by an operator.

5 Claims, 4 Drawing Figures

WEAVING LOOM WITH IMPROVED GUIDE MEANS FOR FABRIC

FIELD OF THE INVENTION

The present invention relates in general to weaving looms and more particularly to guide means by which the produced fabric is smoothly and neatly wound up on a fabric take-up roller without making unsightly creases in the wound fabric.

BACKGROUND OF THE INVENTION

Usually, looms are equipped at a position upstream of the fabric take-up roller with fabric guide devices for allowing the fabric to be neatly wound up on the take-up roller without making creases or wrinkles in the wound fabric. Hitherto, as the fabric guide devices, arch-shaped plates or barrel-shaped rollers have been used, which are arranged to raise up to a maximum the laterally middle portion of the fabric located upstream of the take-up roller. However, in these conventional devices, it is necessary to change the arch-shaped member (or the barrel-shaped roller) by another one having a different length every time the width of the fabric changes due to changing of fabrics to be produced. If this is not done, many unsightly creases or wrinkles tend to appear at the laterally middle portion of the wound fabrics on the take-up roller. It is apparent that the changing of such a fabric guide device with another one is troublesome thus lowering the fabric production efficiency of the loom.

SUMMARY OF THE INVENTION

It is thus an essential object of the present invention to eliminate the problem encountered in the conventional loom mentioned above.

It is an object of the present invention to provide, for a loom, an improved fabric guide means by which the fabric produced is smoothly and neatly wound up on a fabric take-up roller without making unsightly creases or wrinkles in the wound fabric on the roller.

It is still another object of the present invention to provide an improved fabric guide means as above-mentioned, which multiple uses for any kind of fabrics having different widths.

According to the present invention, there is provided a weaving loom having a frame with first and second spaced sections, and a take-up roller spanned between the first and second spaced sections to wind thereon a fabric in a roll form, comprising in combination: a resilient rod spanned between the first and second spaced sections so as to cross the fabric which moves toward the take-up roller to be wound thereon. The rod is in slidable contact with the fabric; and means are provided for flexing the resilient rod to produce a camber which protrudes toward the fabric to press the same and is changeable in shape in response to the degree of biasing force applied to the resilient rod.

BRIEF DESCRIPTION OF THE DRAWINGS

Other objects and advantages of the present invention will become apparent from the following description when taken in conjunction with the accompanying drawings, in which.

DESCRIPTION OF THE PREFERRED EMBODIMENTS

Figure 1:
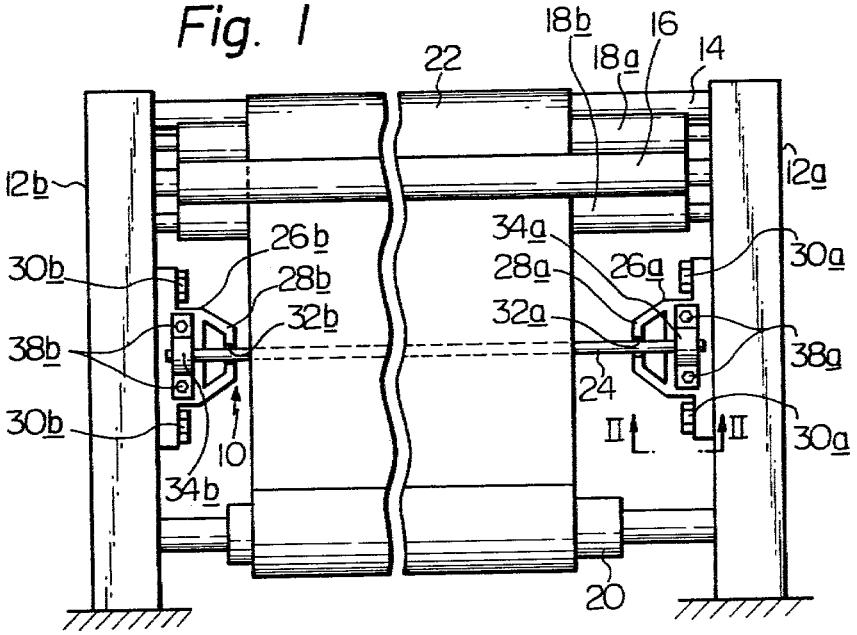
FIG. 1 is a front but partially broken view of a weaving loom equipped with fabric guide device according to the present invention.
Figure 2:
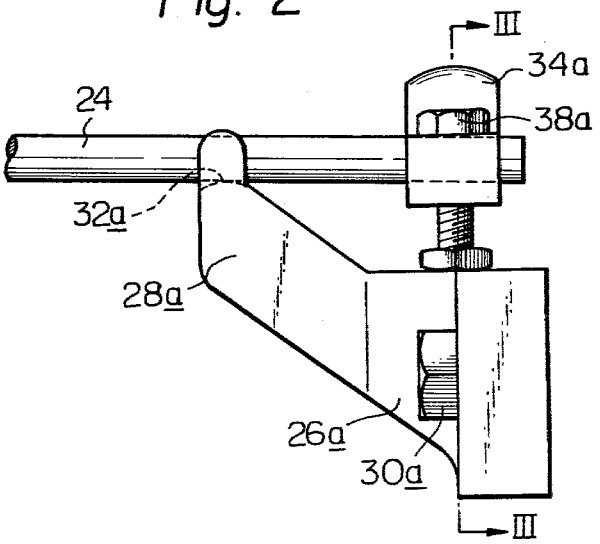
FIG. 2 is an enlarged view taken along the section line II—II of FIG. 1.
Figure 3:
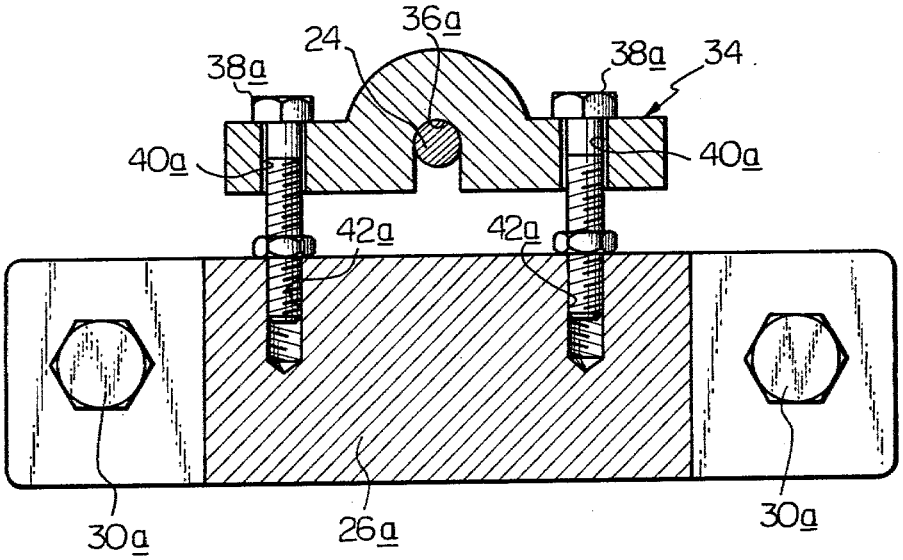
FIG. 3 is a sectional view taken along the section line III—III of FIG. 2.

Referring to FIGS. 1 to 3, especially to FIG. 1, there is illustrated a fabric guide device provided in a weaving loom, generally designated by numeral 10. The weaving loom herein shown has a frame with two sections 12*a* and 12*b* which are spaced from each other, a breast beam 14 spanned between the frame sections 12*a* and 12*b*, a surface roller 16, two press rollers 18*a* and 18*b* and a fabric take-up roller 20. A fabric 22 produced by the loom is passed over the breast beam 14 and then into a limited space defined by the surface roller 16 and the press rollers 18*a* and 18*b* and then to the take-up roller 20 so as to be wound thereon, as shown.

The fabric guide device 10 in the loom comprises a resilient rod 24 which perpendicularly crosses the fabric 22 at a location between the take-up roller 20 and the surface roller 16. The rod 24 is placed in the back side of the fabric 22 as shown by the broken lines indicating the rod 24, and is in contact with the fabric 22 produced by the loom. Both ends of the rod 24 are respectively connected to the corresponding frame sections 12*a* and 12*b* by means of respective camber producing devices which are substantially the same in construction and configuration.

For facilitation of the description, the following explanation of the camber producing device will be made only with respect to one located in a right section of the loom in FIG. 1. Thus for ease of the understanding and description, parts of the camber producing device located in the right section will be indicated by the addition of the subscript of a after each numeral while those of the other camber producing device located in the left section will be indicated by the addition of the subscript of b after each corresponding numeral.

The camber producing device (which is located in the right section of the loom) comprises a support member 26*a* which is integrally provided with a bridge portion 28*a* projecting from the base thereof. The support member 26*a* is secured at the base to the frame 12*a* via bolts 30*a* in such an arrangement that the bridge portion 28*a* extends toward the front side with respect to the surface on which the drawing of FIG. 1 is carried. This will be well understood from FIG. 2. As is best seen from this drawing, the bridge portion 28*a* is formed at the middle portion thereof with a recess 32*a* into which a portion of the resilient rod 24 is received. Preferably, the shape of the recess 32*a* should be accommodated with the cross section of the resilient rod 24. Thus, if the rod 24 is a cylindrical bar, the recess 32*a* should be semi-circular in shape. Designated by numeral 34*a* is a bracket for securing the end of the rod 24 to the support member 26*a*. As is seen in FIG. 3, the bracket 34*a* is formed into a generally Ω-shape, leaving a recess 36*a* therein. The bracket 34*a* is secured to the base of the support member 26*a* by using two threaded bolts 38*a*, which pass through bores 40*a* formed in the bracket 34*a* and adjustably screwed into threaded blind bores 42*a* formed in the base of the support member 26*a*, in such a manner that the recess 36*a* in the bracket 34*a* receives therein the end of the rod 24.

Thus, as will be understood from FIG. 2, movement of the bracket 34*a* toward the base of the support member 26*a* due to screwing of the bolts 38*a* in the advancing direction flexes the end of the resilient rod 24 to vary the camber of the rod 24 spanned between two support members 26*a* and 26*b*. It will be thus appreciated that the shape of the camber of the rod 24 is widely changed by appropriately screwing the bolts 38*a* and 38*b* of the camber producing devices in the advancing or reversing direction. This means that by screwing the bolts 38*a* and 38*b*, the top or maximal raised portion of the rod 24 moves along the rod 24 changing the portion of the fabric 22 which is raised maximal.

Accordingly, if the fabric 22 to be wound on the take-up roller 20 is held in somewhat left side position as shown in FIG. 2, the bolts 38*b* are screwed in the advancing direction or the bolts 38*a* are screwed in the reversing direction so that the top portion defined by the camber of the rod 24 moves leftwardly allowing the laterally middle portion of the fabric 22 to be raised maximal.

Although in the above-described construction, two camber producing devices are used, it is possible to employ only one camber producing device in the present invention so long as the other end of the resilient rod 24 is pivotally connected to the corresponding section of the frame.

Furthermore, the camber producing device used in the present invention may have such a modified construction that the bridge portion 28*a* of the support member 26*a* is vertically movable. In this case, the camber of the rod 24 can be varied by moving the bridge portion 28*a* without touching the bolts 38*a*.

Figure 4:
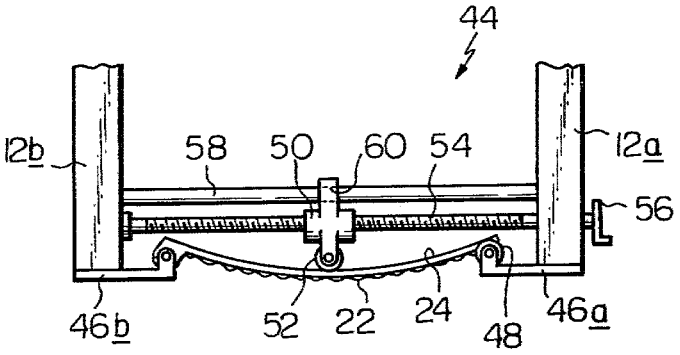
FIG. 4 is a plan but partially cut away view of a weaving loom equipped with another type fabric guide device according to the present invention.

Referring to FIG. 4, there is shown another type fabric guide device according to the present invention, which is generally designated by a numeral 44. The fabric guide device 44 comprises two brackets 46*a* and 46*b* respectively connected to the sections 12*a* and 12*b*. A resilient rod 24 is spanned between the two brackets 46*a* and 46*b* in such an arrangement that the left end thereof is pivotally connected to the extending end of the bracket 46*b* and the right end thereof is put on a bearing surface of a roller 48 which is rotatably supported on the leading end of the bracket 46*a*. A roller mover 50 carrying a roller 52 is threadedly received on a threaded shaft 54. The shaft 54 has at its one end a handle 56 to be rotated about the axis thereof when the handle 56 is rotated by an operator. Designated by numeral 58 is a guide bar which is spanned between the sections 12*a* and 12*b*, passing through a hole 60 formed in the roller mover 50, so that the roller mover 50 can travel along the shaft 54, without rotating about the axis of the same, rightwardly and leftwardly in response to the rotation in one end reverse directions of the handle 56. As shown in the drawing, the roller 52 is arranged to press the resilient rod 24 downwardly in this drawing, that is against the fabric 22 to be wound on the take-up roller (not shown in this drawing) to form the camber of the rod 24. Thus, when the threaded shaft 54 rotates about the axis thereof due to turning of the handle 56, the roller mover 50 travels along the shaft 54 permitting the roller 52 to travel along the resilient rod 24 to vary the camber of the same.

Although in the guide means according to the invention, it is difficult to form a camber which is symmetric with respect to an imaginary plane which is perpendicular to the surface of the fabric and passes through the most raised portion of the camber, it has been revealed that positioning the most raised portion of the camber away slightly from the laterally middle portion of the fabric 22 causes a provision of balanced tensions in the fabric 22 allowing the fabric 22 to be neatly wound on the take-up roller 20 without making wrinkles in the wound fabric.

It should be noted that even though the foregoing description shows only several embodiments, various modifications are apparent to those skilled in the art without departing from the scope of the invention which is only limited by the appended claims.

What is claimed is:

1. A weaving loom comprising a frame with spaced first and second sections, a take-up roller spanned between said first and second sections to wind thereon a fabric in a roll form, a resilient rod spanned between said first and second sections at a position upstream of said take-up roller with respect to the advancing direction of said fabric in a manner to cross the fabric which moves toward the take-up roller, and a rod flexing means for flexing said resilient rod to produce a camber having a summit which protrudes toward said fabric to press the same, WHICH IS CHARACTERIZED IN THAT said rod flexing means comprises:

a roller rotatably connected to one of said first and second sections of the frame for putting thereon one end of said resilient rod;

a threaded shaft extending between said first and second sections in a manner to be rotatable about the axis thereof;

a roller carrying member threadedly disposed on said threaded shaft longitudinally movable along said threaded shaft upon rotation of said shaft; and a roller rotatably connected to said roller carrying member in a manner to run longitudinally in said resilient rod to flex the same when said roller carrying member moves along the threaded shaft.

2. A weaving loom as claimed in claim 1, in which said rod flexing means further comprises a guide bar extending between said first and second sections of said frame and passed through a hole formed in said roller carrying members, so that the roller carrying member is prevented from being rotated about the shaft.

3. A weaving loom comprising a frame with spaced first and second sections; a take-up roller extending between said first and second sections to wind thereon a fabric in a roll form; a resislient rod extending between said first and second sections at a position upstream of said take-up roller with respect to the advancing direction of said fabric in a manner to cross said fabric which moves toward said take-up roller; first and second support members respectively secured to said first and second sections to mount thereon portions of said resilient rod other than ends of the same, first and second brackets respectively disposed on the ends of said resilient rod; and at least first and second bolts, said first bolt connecting said first bracket to a base section of said first support member in a manner to change the distance between one of the ends of said resilient rod and the base section of said first support member upon rotation thereof about the axis thereof, said second bolt connecting said second bracket to a base section of said second support member in a manner to change the distance between the other end of said rod and the base section of said second support member upon rotation thereof about the axis thereof, whereby said resilient rod produces at the middle section thereof a camber the summit of which is shiftable along the rod in response to rotations of said first and second bolts about the axes thereof.

4. A weaving loom having a frame with first and second spaced sections, a take-up roller extending between said first and second spaced sections to wind thereon a fabric in a roll form, a resilient rod extending between said first and second sections so as to cross the fabric which moves toward said takeup roller to be wound thereon, said rod being in slidable contact with said fabric, and means for flexing said resilient rod to produce a camber which protrudes toward said fabric to press the same and is changeable in shape in accordance with the degree of biasing force applied to said resilient rod, said means comprising:

a first roller rotatably connected to one of said first and second spaced sections of the frame and putting thereon one end of said resilient rod;

a threaded shaft extending between said first and second spaced sections and rotatable about the axis thereof;

a roller carrying member threadedly disposed on said threaded shaft to be longitudinally movable when said shaft rotates about the axis thereof; and a second roller rotatably supported on said roller carrying member in a manner to run longitudinally on the resilient rod to flex the same when said roller carrying member moves along the shaft.

5. A weaving loom as claimed in claim 4, further comprising a guide bar extending between said first and second sections of the frame and passing through a hole formed in said roller carrying member, whereby the roller carrying member is prevented from rotation about the threaded shaft even when the shaft is rotated about the axis thereof.

* * * * *